US012390081B2

(12) United States Patent
Park et al.

(10) Patent No.: US 12,390,081 B2
(45) Date of Patent: Aug. 19, 2025

(54) DISHWASHER

(71) Applicant: SAMSUNG ELECTRONICS CO., LTD., Suwon-si (KR)

(72) Inventors: Kitae Park, Suwon-si (KR); Jusik Kim, Suwon-si (KR); Daeseon Yeom, Suwon-si (KR); Junho Lee, Suwon-si (KR); Minho Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 203 days.

(21) Appl. No.: 18/090,001

(22) Filed: Dec. 28, 2022

(65) Prior Publication Data

US 2023/0144208 A1 May 11, 2023

Related U.S. Application Data

(63) Continuation of application No. PCT/KR2021/007811, filed on Jun. 22, 2021.

(30) Foreign Application Priority Data

Jul. 22, 2020 (KR) ..... 10-2020-0090728

(51) Int. Cl.
*A47L 15/42* (2006.01)

(52) U.S. Cl.
CPC ..... *A47L 15/4214* (2013.01); *A47L 15/4209* (2016.11); *A47L 15/4217* (2013.01); *A47L 15/4244* (2013.01); *A47L 15/4274* (2013.01); *A47L 15/4291* (2013.01); *A47L 2401/14* (2013.01)

(58) Field of Classification Search
None
See application file for complete search history.

(56) References Cited

U.S. PATENT DOCUMENTS 4,253,608 A 3/1981 Hunter
4,290,660 A 9/1981 Brezosky
(Continued)

FOREIGN PATENT DOCUMENTS

CN 102525370 A 7/2012
CN 106725180 A 5/2017
(Continued)

OTHER PUBLICATIONS

Written Opinion, PCT/ISA/237, mailed Oct. 8, 2021, in interntional Application PCT/KR2021/007811.
(Continued)

*Primary Examiner* — Levon J Shahinian
(74) *Attorney, Agent, or Firm* — STAAS & HALSEY LLP

(57) ABSTRACT

Disclosed herein is a dishwasher. The dishwasher includes a tub forming a washing chamber and a water tank mounted on an outer circumferential surface of the tub to communicate with the tub. The water tank includes a reservoir provided to store washing water and including a washing water outlet, a partition wall forming one side surface of the reservoir, an outside air inlet provided to maintain an internal pressure, a flow path connecting the reservoir to the outside air inlet, and an inclined rib having an inclination with respect to a water surface of the washing water in the reservoir and provided to form an air pocket.

14 Claims, 15 Drawing Sheets

1

(56) References Cited

U.S. PATENT DOCUMENTS

| | | | |
|---|---|---|---|
| 4,294,078 | A | 10/1981 | MacCracken |
| 4,357,176 | A | 11/1982 | Anthony |
| 4,359,250 | A | 11/1982 | Jenkins |
| 4,417,782 | A | 11/1983 | Clarke et al. |
| 4,823,818 | A | 4/1989 | De Buyer |
| 4,886,190 | A | 12/1989 | Kirschner et al. |
| 5,032,015 | A | 7/1991 | Chistianson |
| 5,104,237 | A | 4/1992 | Slocum |
| RE34,166 | E | 1/1993 | Davis |
| 5,244,146 | A | 9/1993 | Jefferson et al. |
| 5,285,798 | A | 2/1994 | Banerjee et al. |
| 5,634,257 | A | 6/1997 | Kajiwara et al. |
| 5,640,764 | A | 6/1997 | Strojnik |
| 5,673,716 | A | 10/1997 | Gurubatham et al. |
| 5,704,966 | A | 1/1998 | Rohrback et al. |
| 5,808,645 | A | 9/1998 | Reeves et al. |
| 5,843,140 | A | 12/1998 | Strojnik |
| 5,958,538 | A | 9/1999 | Kessler |
| 6,029,442 | A | 2/2000 | Caren et al. |
| 6,083,524 | A | 7/2000 | Sawhney et al. |
| 6,119,853 | A | 9/2000 | Garrill et al. |
| 6,127,058 | A | 10/2000 | Pratt et al. |
| RE36,951 | E | 11/2000 | Cooper et al. |
| 6,177,095 | B1 | 1/2001 | Sawhney et al. |
| 6,184,473 | B1 | 2/2001 | Reece et al. |
| 6,230,989 | B1 | 5/2001 | Haverstraw et al. |
| 6,301,853 | B1 | 10/2001 | Simpson et al. |
| 6,327,994 | B1 | 12/2001 | Labrador |
| 6,359,231 | B2 | 3/2002 | Reece et al. |
| 6,434,783 | B1 | 8/2002 | Arnold et al. |
| 6,454,186 | B2 | 9/2002 | Haverstraw et al. |
| 6,460,483 | B1 | 10/2002 | Northrop et al. |
| 6,601,542 | B2 | 8/2003 | Campion |
| 6,632,335 | B2 | 10/2003 | Kunisawa et al. |
| 6,651,035 | B1 | 11/2003 | Lang |
| 6,739,523 | B2 | 5/2004 | Haverstraw et al. |
| 6,745,152 | B1 | 6/2004 | Lang |
| 6,869,204 | B2 | 3/2005 | Morgan et al. |
| 6,918,370 | B2 | 7/2005 | Yamaoka et al. |
| 6,934,976 | B2 | 8/2005 | Parsons et al. |
| 7,036,243 | B2 | 5/2006 | Doh et al. |
| 7,039,555 | B2 | 5/2006 | Lang |
| 7,044,623 | B2 | 5/2006 | Olsson et al. |
| 7,204,259 | B2 | 4/2007 | Crisp, III |
| RE39,713 | E | 7/2007 | Sawhney et al. |
| 7,251,905 | B2 | 8/2007 | Doh et al. |
| 7,372,538 | B2 | 5/2008 | Binnard |
| 7,383,721 | B2 | 6/2008 | Parsons et al. |
| 7,479,215 | B2 | 1/2009 | Carson et al. |
| 7,517,445 | B2 | 4/2009 | Carson et al. |
| 7,597,784 | B2 | 10/2009 | Bednarek et al. |
| 7,655,603 | B2 | 2/2010 | Crews |
| 7,815,746 | B2 | 10/2010 | Lee et al. |
| 7,819,986 | B2 | 10/2010 | Ryu et al. |
| 7,820,995 | B2 | 10/2010 | Gadini et al. |
| 8,029,927 | B2 | 10/2011 | Tucholski |
| 8,083,863 | B2 | 12/2011 | Oppel et al. |
| 8,297,353 | B2 | 10/2012 | Roddy et al. |
| 8,375,970 | B2 | 2/2013 | Lautzenheiser et al. |
| 8,439,456 | B2 | 5/2013 | Kiechle et al. |
| 8,441,361 | B2 | 5/2013 | McAlister |
| 8,524,320 | B1 | 9/2013 | Gillanders et al. |
| 8,590,753 | B2 | 11/2013 | Marina et al. |
| 8,597,505 | B2 | 12/2013 | Fulkerson et al. |
| 8,711,328 | B2 | 4/2014 | Shibazaki |
| 8,724,079 | B2 | 5/2014 | Shibazaki |
| 8,772,667 | B2 | 7/2014 | Yang et al. |
| 8,800,165 | B2 | 8/2014 | Kwon et al. |
| 8,828,148 | B2 | 9/2014 | Poyner et al. |
| 8,829,385 | B2 | 9/2014 | Yang et al. |
| 8,962,048 | B2 | 2/2015 | Gerbaulet et al. |
| 9,273,815 | B2 | 3/2016 | Gillanders et al. |
| 9,492,053 | B2 | 11/2016 | Shin et al. |
| 9,611,973 | B2 | 4/2017 | Gillanders et al. |
| 9,834,918 | B2 | 12/2017 | Veros et al. |
| 9,861,253 | B2 | 1/2018 | Lee |
| 10,221,560 | B2 | 3/2019 | Köster |
| 10,279,375 | B2 | 5/2019 | Gillanders et al. |
| 10,468,145 | B2 | 11/2019 | Singh |
| 10,548,444 | B2 | 2/2020 | Sun et al. |
| 11,337,582 | B2 | 5/2022 | Hahm |
| 2006/0096621 | A1 | 5/2006 | Lee et al. |
| 2015/0068565 | A1* | 3/2015 | Lee ..... C02F 1/42 134/109 |

FOREIGN PATENT DOCUMENTS

| | | | |
|---|---|---|---|
| CN | 208591010 | U | 3/2019 |
| CN | 210055925 | U | 2/2020 |
| EP | 0 235 249 | B1 | 12/1992 |
| EP | 0 876 789 | B1 | 10/2003 |
| EP | 1 021 697 | B1 | 10/2004 |
| EP | 1 195 429 | B1 | 6/2006 |
| EP | 1 094 535 | B1 | 10/2006 |
| EP | 1 767 689 | B1 | 4/2010 |
| EP | 2 175 767 | B1 | 10/2010 |
| EP | 1 587 692 | B1 | 11/2010 |
| EP | 1 181 323 | B1 | 6/2011 |
| EP | 1 701 648 | B1 | 4/2012 |
| EP | 2 108 728 | B1 | 4/2014 |
| EP | 2 375 945 | B1 | 4/2014 |
| EP | 2 067 428 | B1 | 11/2014 |
| EP | 2 267 759 | B1 | 11/2014 |
| EP | 2 287 893 | B1 | 4/2016 |
| EP | 2 287 894 | B1 | 9/2016 |
| EP | 1 718 445 | B1 | 12/2016 |
| EP | 2 950 147 | B1 | 4/2017 |
| EP | 2 470 702 | B1 | 6/2017 |
| EP | 2 470 700 | B1 | 8/2017 |
| EP | 2 242 413 | B1 | 11/2017 |
| EP | 2 114 236 | B1 | 8/2018 |
| EP | 3 186 453 | B1 | 10/2018 |
| EP | 2 759 787 | B1 | 7/2019 |
| EP | 2 658 795 | B1 | 9/2019 |
| KR | 1998-040322 | | 9/1998 |
| KR | 10-0550853 | | 2/2006 |
| KR | 10-0630974 | | 10/2006 |
| KR | 10-0682655 | | 2/2007 |
| KR | 10-0717471 | | 5/2007 |
| KR | 10-0722017 | | 5/2007 |
| KR | 10-0772230 | | 11/2007 |
| KR | 10-1054130 | | 8/2011 |
| KR | 10-1054154 | | 8/2011 |
| KR | 10-1247049 | | 4/2013 |
| KR | 10-1266870 | | 5/2013 |
| KR | 10-2019-0087150 | | 7/2019 |
| KR | 10-2045462 | | 11/2019 |
| KR | 10-2125724 | | 6/2020 |
| WO | WO 2020/016763 | A1 | 1/2020 |

OTHER PUBLICATIONS

International Search Report, PCT/ISA/210, mailed Oct. 8, 2021, in International Application PCT/KR2021/007811.

* cited by examiner

DISHWASHER

CROSS-REFERENCE TO RELATED APPLICATIONS

This application is a continuation of International Application PCT/KR2021/007811, filed Jun. 22, 2021, and claims foreign priority to Korean application 10-2020-0090728, filed Jul. 22 2020, the disclosures of which are incorporated herein by reference in their entireties.

BACKGROUND

1. Field

The present disclosure relates to a dishwasher, and more particularly, to a dishwasher including an improved water tank structure.

2. Description of Related Art

In general, a dishwasher is a device for washing and drying stored dishes by spraying washing water at a high pressure. The dishwasher operates such that washing water is sprayed at high pressure into a washing tub in which the dishes are stored, and the sprayed washing water comes into contact with the dishes to wash foreign substances such as food waste on a surface of the dishes.

Particularly, the dishwasher includes a tub in which a washing tub is formed and a sump mounted on a bottom of the tub to store washing water. Washing water is moved to a spray nozzle by a pumping action of a sump pump mounted inside the sump, and the washing water moved to the spray nozzle is sprayed at a high pressure through a spray hole formed at an end of the spray nozzle. The washing water sprayed at a high pressure hits a surface of the dishes, and foreign substances, such as food waste, on the dishes falls to a bottom of the tub.

The dishwasher is provided with a water tank that delivers the supplied washing water to the sump. The water tank may previously store water used for washing and set cold water of a water supply to a temperature corresponding to the room temperature. Accordingly, it is possible to reduce energy used to heat the washing water.

However, when the dishwasher is laid down during the after-sales service, the washing water stored in the water tank may flow out into an outside air inlet formed in the water tank to maintain an internal pressure.

In general, a flow meter configured to detect a flow rate of water supplied to the water tank and a printed circuit board (PCB) coupled to the flow meter are accommodated in the water tank such that the flow meter, the PCB and the water tank are fused integrally with each other so as not to be separated from each other. Accordingly, if a defect occurs in the PCB, the entire water tank may need to be replaced.

SUMMARY

One aspect of the present disclosure provides a dishwasher including a tub forming a washing chamber, a water tank mounted on an outer circumferential surface of the tub and including a reservoir in which washing water is storable, and an inclined rib configured to, with washing water stored in the reservoir, have an inclination with respect to a water surface of the washing water to allow an air pocket to be formed under the inclined rib. The dishwasher may further include a sump configured to receive washing water stored in the reservoir and to supply the received washing water to the tub.

The water tank may further include a partition wall forming a side of the reservoir. The inclined rib may include an extension connected to the partition wall, and a free end at one end of the extension to allow washing water in the reservoir to flow to an upper portion of the inclined rib.

The inclined rib may be inclined to allow the extension to be positioned higher than the free end.

The partition wall, the extension, and the water surface of the washing water may form a closed space, thereby forming the air pocket.

The water tank may further include a first flow path along which washing water is suppliable to the water tank from an outside. The partition wall may form a portion of a flow path wall forming the first flow path.

The water tank may further include a tub connection port formed to communicate with the tub, an outside air inlet, and a second flow path connecting the reservoir, the tub connection port, and the outside air inlet to allow air to flow.

The inclined rib may be provided to trap a portion of the washing water stored in the reservoir in response to the water tank being rotated.

The water tank may further include a water overflow prevention rib extending along a periphery of the tub connection port so as to interfere with a flow of washing water, which overflows from the reservoir, along the second flow path due to the rotation of the water tank.

The water tank may further include a water collecting rib formed between the tub connection port and the outside air inlet so as to collect the washing water in response to the rotation of the water tank.

The water collecting rib may include a first wall extending from the tub connection port to a lateral side of the water tank, a second wall connected to the first wall and extending upward, and a third wall connected to the second wall and extending to an upper side of the tub connection port.

The water tank may further include a plurality of leakage prevention ribs formed between the water collecting rib and the outside air inlet so as to prevent water, which is not collected by the water collecting rib, from leaking to the outside air inlet in response to the rotation of the water tank.

The water tank may further include a flow meter configured to detect a flow rate of washing water supplied to the water tank, a first case in which the flow meter is accommodated, and a second case corresponding to the first case and provided to cover a portion of the flow meter.

The second case may include a folding flange provided to be foldable and including a hook formed on one end of the folding flange. The hook may be coupled to the cover to allow the folding flange to cover the flow meter.

The flow meter may include a body including an impeller, and a printed circuit board (PCB) detachably mounted to the body so as to be connected to a wire. The second case may include a wire hanger formed to be cut so as to guide the wire.

The second case may further include a guard protruding from an outer surface of the second case to prevent moisture from penetrating into the PCB.

Another aspect of the present disclosure provides a dishwasher including a tub forming a washing chamber, and a water tank mounted on an outer circumferential surface of the tub so as to receive washing water from an external water source. The water tank includes a flow meter including a sensor configured to detect a flow rate of supplied washing water, a first case in which the flow meter is accommodated, and a second case coupled to the first case and including a folding flange provided to cover the flow meter.

The second case may include a cover provided to cover a portion of the flow meter. The folding flange may be formed integrally with the second case so as to be foldable, and a hook coupled to the cover may be formed on one end of the folding flange.

The flow meter may include a body including an impeller, and a printed circuit board (PCB) detachably mounted to the body so as to be connected to a wire. The second case may include a wire hanger formed to be cut so as to guide the wire.

Another aspect of the present disclosure provides a dishwasher including a tub forming a washing chamber and a water tank mounted on an outer circumferential surface of the tub to communicate with the tub. The water tank includes a reservoir provided to store washing water and including a washing water outlet, a partition wall forming one side surface of the reservoir, an outside air inlet provided to maintain an internal pressure, a flow path connecting the reservoir to the outside air inlet, and an inclined rib having an inclination with respect to a water surface of the washing water in the reservoir and provided to form an air pocket. The inclined rib includes an extension connected to the partition wall, and a free end provided at one end of the extension to form the washing water outlet.

The free end may be positioned to be lower than the extension.

Additional aspects will be set forth in part in the description which follows and, in part, will be apparent from the description, or may be learned by practice of the presented embodiments.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
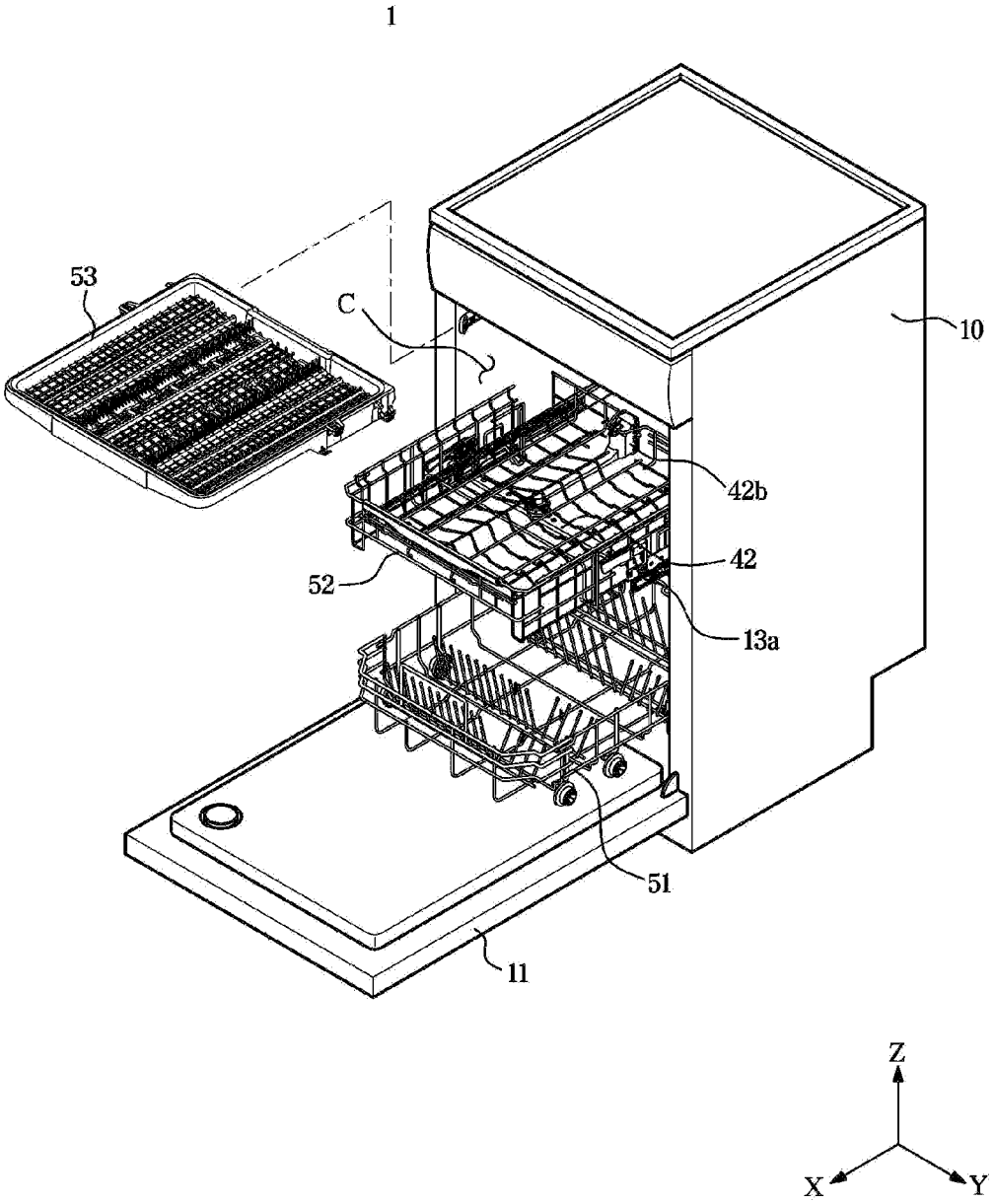
FIG. 1 is a perspective view of a dishwasher according to one embodiment of the present disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function. Shapes and sizes of elements in the drawings may be exaggerated for clear description.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

According to various embodiments of the present disclosure, a dishwasher includes an improved structure to prevent washing water from leaking to an outside even when a water tank is rotated during an after-sales service.

According to various embodiments of the present disclosure, a dishwasher includes an improved structure to allow only a printed circuit board (PCB) sensor inside a water tank to be replaced.

According to various embodiments of the present disclosure, an inclined rib is provided to form an air pocket, and thus when a water tank is tilted, it is possible to minimize an amount of washing water overflowing out of a reservoir by using an air pressure.

According to various embodiments of the present disclosure, even when washing water overflows out of a reservoir, it is possible to prevent the washing water from leaking to an outside through an outside air inlet.

According to various embodiments of the present disclosure, it is possible to separate and replace only a printed circuit board (PCB) from an outside of a dishwasher because a folding flange is provided. Accordingly, it is possible to reduce production and repair costs.

The disclosure will be described more fully hereinafter with reference to the accompanying drawings.

Figure 2:
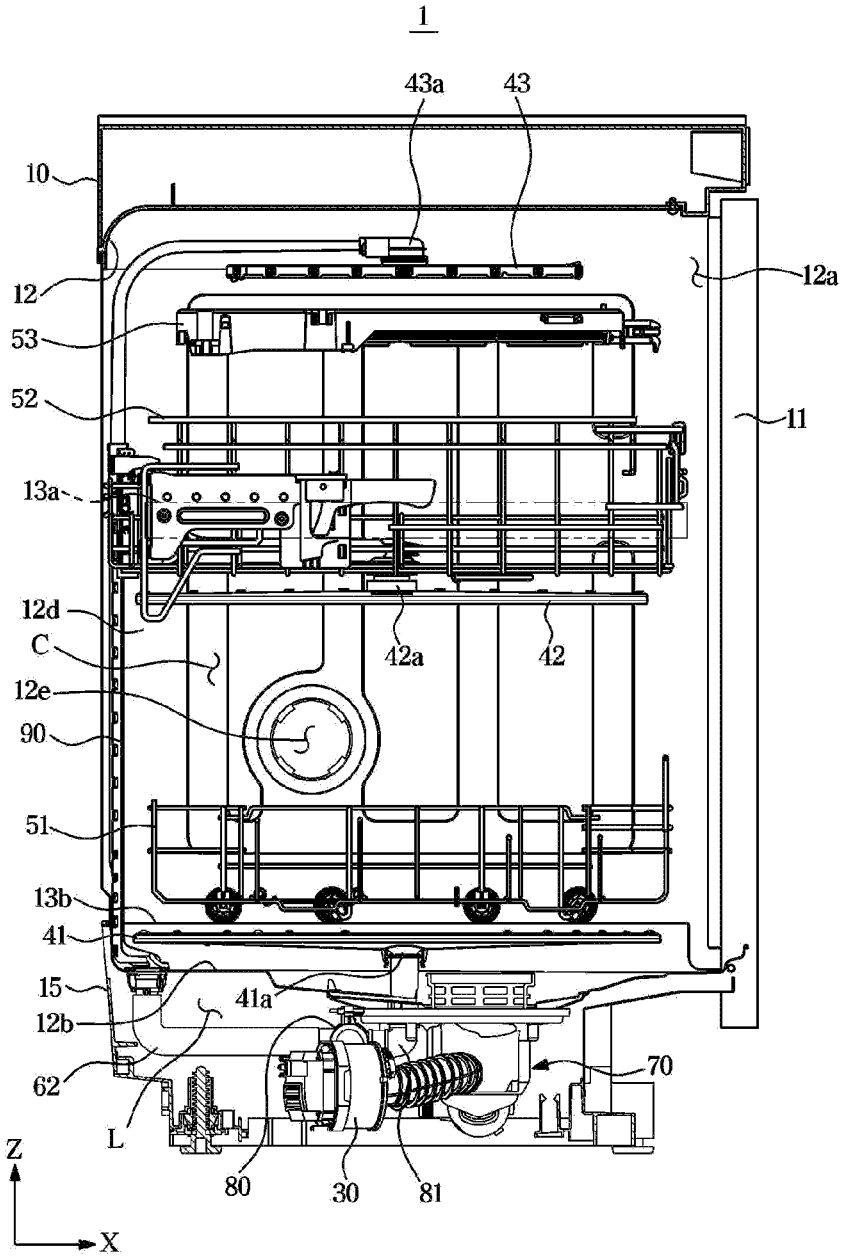
FIG. 2 is a schematic side cross-sectional view of the dishwasher according to one embodiment of the present disclosure.

FIG. 1 is a perspective view of a dishwasher according to one embodiment of the present disclosure. FIG. 2 is a schematic side cross-sectional view of the dishwasher according to one embodiment of the present disclosure.

As illustrated in FIGS. 1 and 2, a dishwasher 1 may include a main body 10 forming an exterior.

The dishwasher 1 may include a tub 12 provided inside the main body 10. The tub 12 may be provided in a substantially box shape. One surface of the tub 12 may be open. That is, the tub 12 may include an opening 12*a*. As an example, a front surface of the tub 12 may be opened.

The dishwasher 1 may further include a door 11 configured to open and close the opening 12*a* of the tub 12. The door 11 may be installed in the main body 10 to open and close the opening 12*a* of the tub 12. The door 11 may be rotatably installed in the main body 10.

The dishwasher 1 may further include a storage container provided inside the tub 12 to accommodate dishes.

The storage container may include a plurality of baskets 51, 52, and 53. Dishes having a relatively large volume may be accommodated in the plurality of baskets 51, 52, and 53. However, the types of dishes accommodated in the plurality of baskets 51, 52 and 53 are not limited to relatively large-volume dishes. That is, in the plurality of baskets 51, 52, and 53, not only large-volume dishes but also relatively small-volume dishes may be accommodated.

The storage container may include an intermediate basket 52 positioned in a middle portion with respect to a height direction of the dishwasher 1, and a lower basket 51 positioned in a lower portion with respect to the height direction of the dishwasher 1. The intermediate basket 52 may be provided to be supported by an intermediate guide rack 13*a*, and the lower basket 51 may be provided to be supported by a lower guide rack 13*b*. The intermediate guide rack 13*a* and the lower guide rack 13*b* may be installed on a side surface 12*d* of the tub 12 so as to be slidable toward the opening 12*a* of the tub 12. Particularly, the intermediate guide rack 13*a* and the lower guide rack 13*b* may be installed on an inner surface of the side surface 12*d* of the tub 12.

The storage container may include an upper basket 53 positioned in an upper portion with respect to the height direction of the dishwasher 1. The upper basket 53 may be formed in a rack assembly type to accommodate relatively small-volume dishes. It is appropriate that the upper basket 53 may accommodate a cooking utensil such as a ladle, a knife, or a turner, or cutlery. In addition, the rack assembly may accommodate a small cup such as an espresso cup. However, the kind of dishes accommodated in the upper basket 53 is not limited to the above example.

Figure 3:
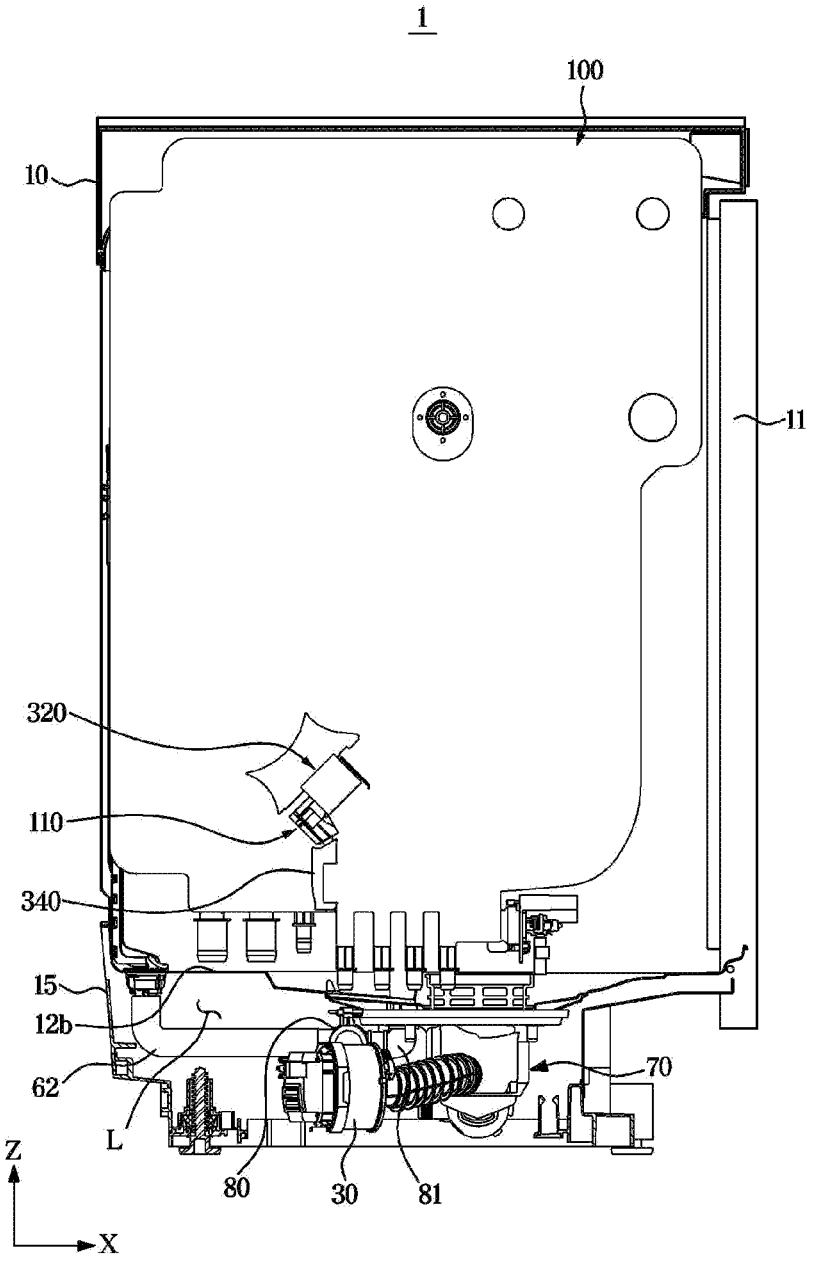
FIG. 3 is a view illustrating a state in which a water tank of the dishwasher according to an embodiment of the present disclosure is mounted on a tub.

In addition, the shape of the storage container is not limited to the shape shown in FIGS. 1 to 3. For example, the upper basket 53 may be removed according to the size of the tub 12. Therefore, the storage container may be implemented only with the intermediate basket 52 and the lower basket 51.

The dishwasher 1 may include a sump 70 provided to store washing water. The dishwasher 1 may include a washing chamber C formed inside the tub 12. The washing chamber C may be defined as an inner space of the tub 12. The sump 70 may be configured to supply washing water to the tub 12.

The dishwasher 1 may further include a plurality of spray units 41, 42, and 43 configured to spray washing water. The spray unit may include a first spray unit 41 arranged below the lower basket 51 with respect to the height direction of the dishwasher 1, a second spray unit 42 arranged below the intermediate basket 52 with respect to the height direction of the dishwasher 1, and a third spray unit 43 arranged above the upper basket 53 with respect to the height direction of the dishwasher 1.

The first spray unit 41 may be configured to be rotated about a first rotating shaft 41*a*, and the second spray unit 42 may be configured to be rotated about a second rotating shaft 42*a*, and the third spray unit 43 may be configured to be rotated about a third rotating shaft 43*a*.

However, the disclosure is not limited thereto. The first spray unit 41 may be fixed to one side of a lower surface 12*b* unlike the second spray unit 42 and the third spray unit 43. In this case, the first spray unit 41 may be configured to spray washing water in a substantially horizontal direction by a fixed nozzle, and the washing water sprayed in the horizontal direction from the nozzle of the first spray unit 41 may be directed to the upper side because a direction of the sprayed water is changed by a switching assembly. The switching assembly may be installed on a rail by a holder, and translated along the rail.

The third spray unit 43 may spray the washing water toward the dishes stored in the upper basket 53, the intermediate basket 52, and the lower basket 51. The second spray unit 42 may spray the washing water toward the dishes stored in the intermediate basket 52 and the upper basket 53.

The first spray unit 41 may be arranged on the lower surface 12*b* of the tub 12, unlike the second spray unit 42 and the third spray unit 43. Particularly, the first spray unit 41 may be arranged to be fixed to the sump 70.

The dishwasher 1 may include a circulation pump 30 configured to pump water stored in the sump 70 toward the spray unit. The washing water pumped by the circulation pump 30 may be supplied to the first spray unit 41 through an alternating device 80 connected to the circulation pump 30. Alternatively, the washing water pumped by the circulation pump 30 may be moved upward by a duct 90 and then supplied to the second spray unit 42 or the third spray unit 43.

As mentioned above, the washing water stored in the sump 70 or washing water introduced into the dishwasher 1 from the outside may flow to the alternating device 80 by the circulation pump 30.

The alternating device 80 may supply the washing water to the first spray unit 41 through a connector 81 connected to the first spray unit 41, and may supply the washing water to the duct 90 through a flow path 62 connected to the duct 90.

The alternating device 80 may selectively supply the washing water to at least one of the connector 81 and the duct 90.

The dishwasher 1 may include a machine room L arranged below the tub 12. At least a portion of the connector 81, and the flow path 62 may be arranged in the machine room L arranged below the washing chamber C. That is, at least a portion of the connector 81 and the flow path 62 may be arranged lower than the lower surface 12*b* of the tub 12 with respect to the height direction of the dishwasher 1.

Through the connector 81 and the flow path 62, the washing water may flow to the first spray unit 41 and the duct 90 arranged inside the washing chamber C. The washing water may flow to the second spray unit 42 and the third spray unit 43 through the duct 90.

The above-described circulation pump 30, sump 70, and alternating device 80 may be arranged in the machine room L and further a water supply hose (not shown) and a drain hose (not shown) may be arranged in the machine room L.

The tub 12 may include a connection hole 12*e* formed in the side surface 12*d*. The connection hole 12*e* may be provided to communicate with a tub connection port 240 of a water tank 100 to be described later.

Figure 4:
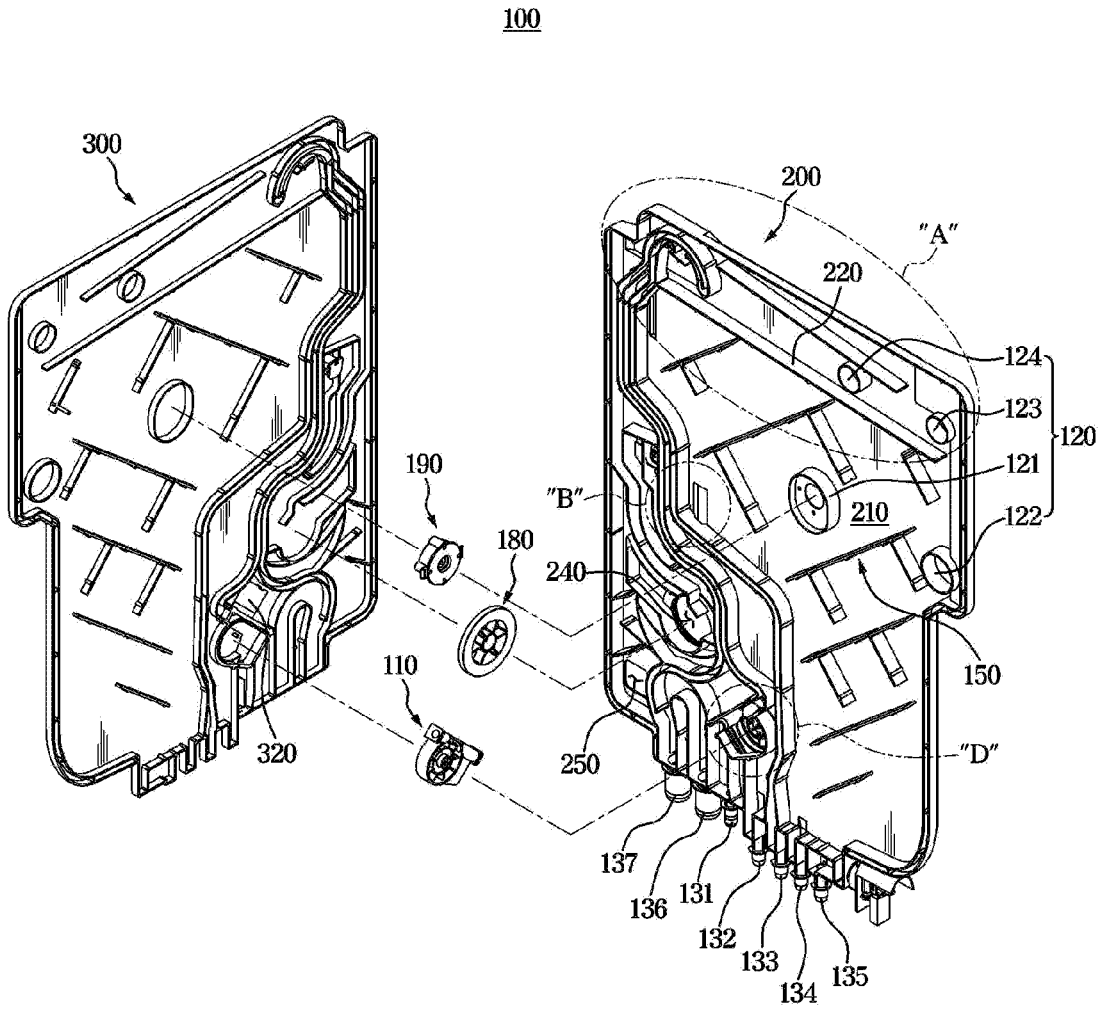
FIG. 4 is an exploded view illustrating a configuration of the water tank of the dishwasher according to an embodiment of the present disclosure.
Figure 5:
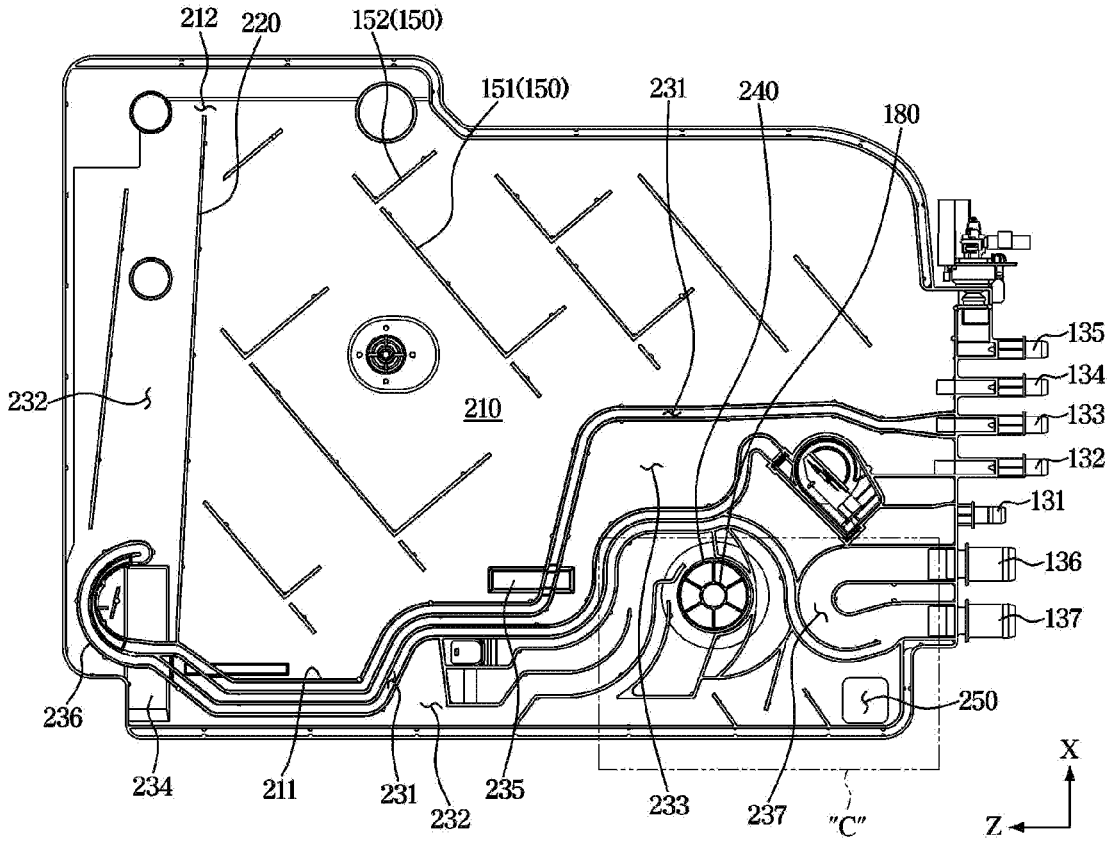
FIG. 5 is a view illustrating a state in which the water tank of the dishwasher according to an embodiment of the present disclosure is rotated.
Figure 6:
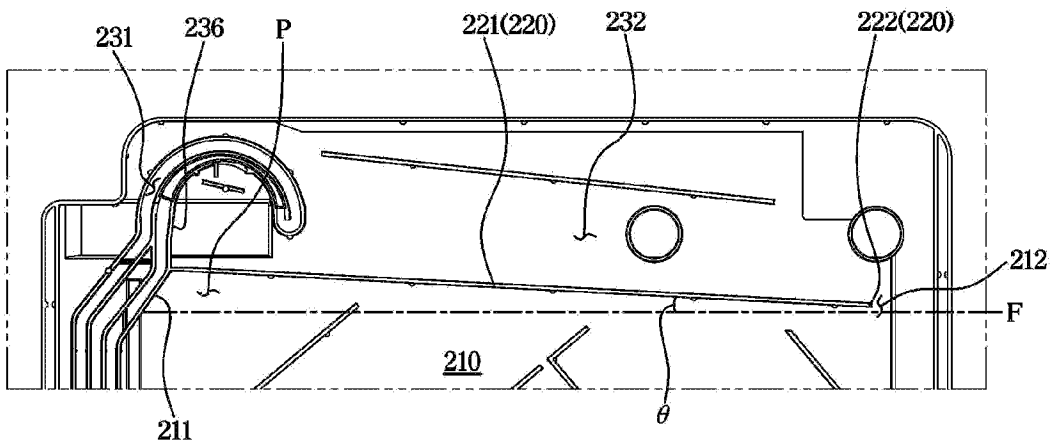
FIG. 6 is an enlarged view of a part A of FIG. 4.
Figure 7:
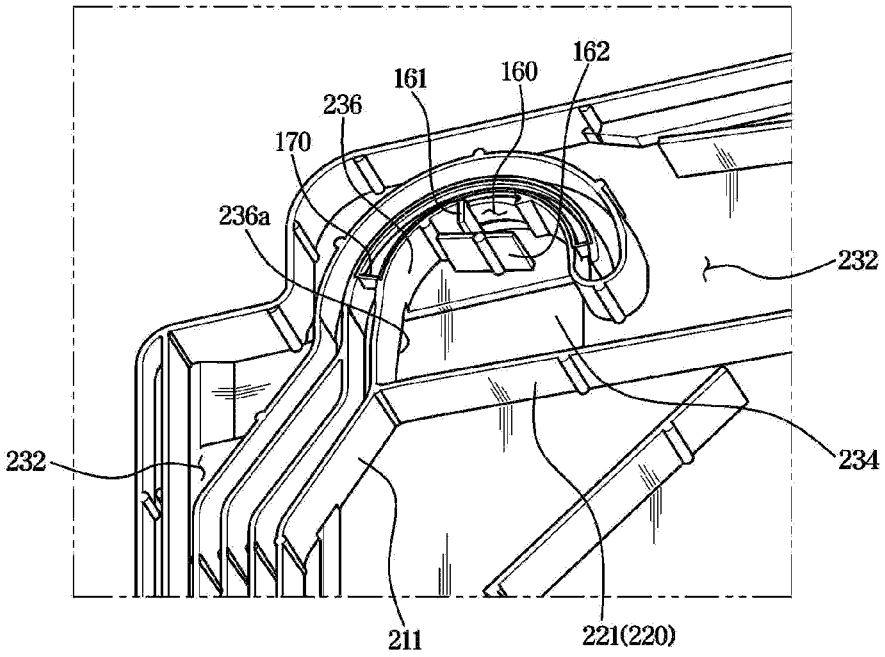
FIG. 7 is a view illustrating a portion of a flow path of the dishwasher according to one embodiment of the present disclosure.
Figure 8:
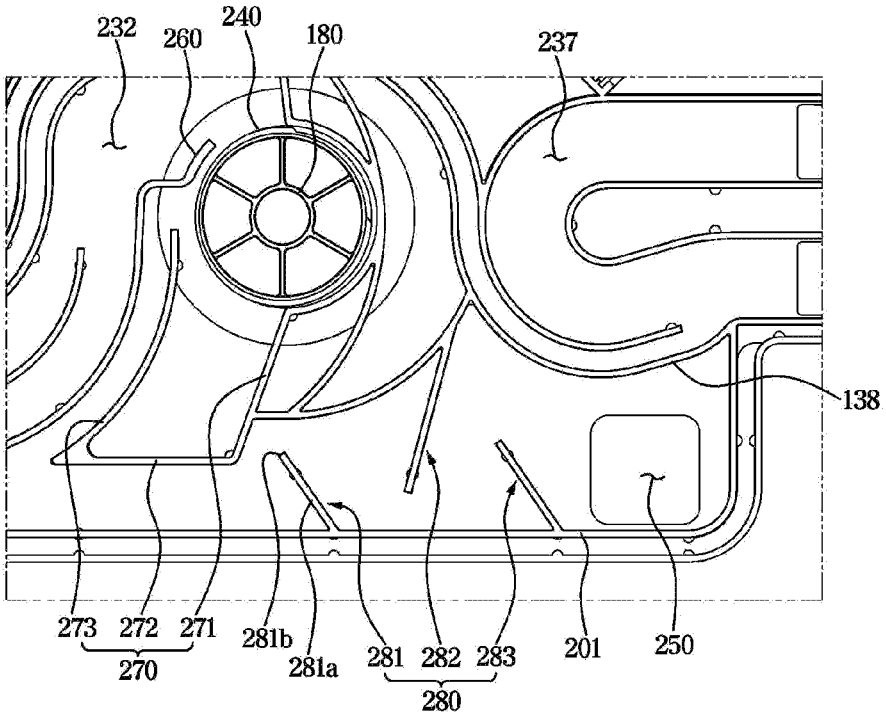
FIG. 8 is an enlarged view of a part C of FIG. 5.
Figure 9:
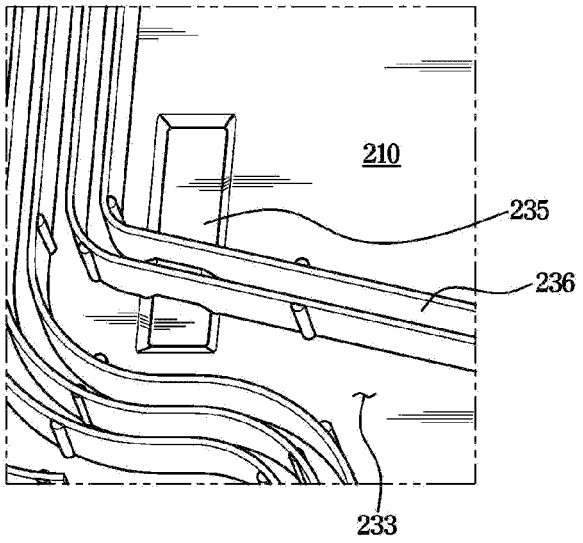
FIG. 9 is an enlarged view of a part B of FIG. 4.

FIG. 3 is a view illustrating a state in which a water tank of the dishwasher according to an embodiment of the present disclosure is mounted on the tub 12. FIG. 4 is an exploded view illustrating a configuration of the water tank of the dishwasher according to an embodiment of the present disclosure. FIG. 5 is a view illustrating a state in which the water tank of the dishwasher according to an embodiment of the present disclosure is rotated. FIG. 6 is an enlarged view of a part A of FIG. 4. FIG. 7 is a view illustrating a portion of a flow path of the dishwasher according to one embodiment of the present disclosure. FIG. 8 is an enlarged view of a part C of FIG. 5. FIG. 9 is an enlarged view of a part B of FIG. 4.

As illustrated in FIG. 3, the dishwasher 1 may include the water tank 100. The water tank 100 may be mounted on an outer circumferential surface of the tub 12. Particularly, the water tank 100 may be mounted on the side surface 12*d* of the tub 12. The water tank 100 may be connected to the sump 70 to supply washing water to the sump 70. However, a specific connection related thereto is not shown in FIG. 3.

The water tank 100 may typically include a flow meter 110 configured to detect an amount of washing water supplied to the inside of the dishwasher 1. In addition, a folding flange 320 configured to be folded may be formed on the outer circumferential surface of the water tank 100. Details related to this will be described later.

In recent years, more functions have been added to the water tank 100 due to an energy saving issue. The water tank 100 may previously store the washing water used for washing, so as to allow cold water of a water supply to be a temperature at the same as the room temperature.

The washing water may be stored in a reservoir 210 of the water tank 100 for a predetermined period of time, and accordingly, a temperature of the washing water (about 15° C.) is similar to the room temperature (about 23° C.). Therefore, it is possible to reduce an amount of energy that is used to increase the temperature of the washing water.

Accordingly, it is possible to reduce the energy required to heat the washing water used for washing.

Referring to FIG. 4, the water tank 100 may include a plurality of cases 200 and 300. The water tank 100 may include a first case 200 and a second case 300. The first case 200 and the second case 300 may be coupled to each other. Particularly, the first case 200 and the second case 300 may be fused to each other.

The first case 200 and the second case 300 may be coupled to each other to form the water tank 100. The first case 200 may be provided to correspond to the second case 300 to form a plurality of flow paths 231, 232, 233, and 234 and the reservoir 210 in the water tank 100.

Accordingly, unless otherwise described, structures of an inner surface of the first case 200 and the second case 300 facing each other may be formed to be mostly the same. Hereinafter the first case 200 will be described, but the second case 300 may also include the same structure and be given the same reference numerals.

The first case 200 is provided to be coupled to the tub 12. The first case 200 is provided to be coupled to the side surface 12*d* of the tub 12. The second case 300 may be coupled to the first case 200 to be arranged outside the tub 12 more than the first case 200.

The first case 200 may include an outside air inlet 250 provided to discharge air to the outside or introduce air from the outside. Alternatively, the outside air inlet 250 may be formed in the second case 300.

The first case 200 may include the tub connection port 240 provided to introduce air into the tub 12 or provided to discharge air from the tub 12. The tub connection port 240 may be connected to the connection hole 12*e* formed in the side surface 12*d* of the tub 12.

The water tank 100 may include a cap member 180 connecting the water tank 100 and the side surface 12*d* of the tub 12 without the leakage. The cap member 180 may be mounted on the tub connection port 240 of the water tank 100 and the connection hole 12*e* of the tub 12 to maintain the sealing.

A tub fixer 120 configured to couple the water tank 100 to the side surface 12*d* of the tub 12 may be provided in the first case 200. One or more tub fixer 120 may be provided. The water tank 100 may be fixed to the side surface 12*d* of the tub 12 through the tub fixer 120.

The tub fixer 120 may include a first tub fixer 121, a second tub fixer 122, a third tub fixer 123, and a fourth tub fixer 124.

The first tub fixer 121 to the fourth tub fixer 124 may be arranged to be spaced apart from each other. In the embodiment of the present disclosure, the four tub fixers including the first tub fixer 121 to the fourth tub fixer 124 are illustrated as being spaced apart from each other in the water tank 100, but the present disclosure is limited thereto. For example, the number of tub fixers 120 may vary according to the size of the first case 200 and the size and shape of the tub 12.

The water tank 100 may include a coupling member 190. The coupling member 190 may be inserted into the first tub fixer 120 formed in the first case 200 and the second case 300 of the water tank 100 so as to assist the coupling between the tub 12 and the water tank 100.

The water tank 100 may include the reservoir 210. Washing water that is softened may be introduced into the reservoir 210 through a water supplier 131 to be described later. As the washing water introduced into the reservoir 210 is stored inside the reservoir 210 and maintained at the room temperature, it is possible to reduce energy required for heating the washing water.

The water tank 100 may include the water supplier 131 formed on a lower end 281*b* of the first case 200 and configured to receive water from the outside. The water tank 100 may include a water softener connector 133 provided to allow water introduced from the water supplier 131 to be moved to a water softener (not shown).

In addition, the water tank 100 may include a soft water inlet 134 formed at the lower end 281*b* and provided to allow water, which is softened, to be introduced from the water softer (not shown) to the reservoir 210, and a sump connector 135 provided to allow washing water stored in the reservoir 210 to be discharged to the sump 70.

The water tank 100 may include a sump drain connector 136 connected to the sump 70 to allow washing water, which is after use, to be discharged to the outside by a drain pump (not shown), and a drain hose connector 137 provided to allow water, which is introduced into the sump drain connector 136, to be discharged to the outside.

In addition, the water tank 100 may include a regeneration water inlet 132 through which washing water flows from the reservoir 210 for ion exchange of the water softer (not shown) that is separately provided.

The water tank 100 may include the flow meter 110. The flow meter 110 may be configured to detect the flow rate of the washing water supplied from the water supplier 131. A detailed configuration of the flow meter 110 will be described later.

The water tank 100 may include a plurality of ribs 150. Particularly, the plurality of ribs 150 may be formed in the reservoir 210 of the water tank 100. The plurality of ribs 150 may guide the flow of washing water introduced from the water supplier 131 to the reservoir 210. Particularly, the plurality of ribs 150 may be provided to allow the washing water to be uniformly moved in various directions and supplied to the reservoir 210.

Accordingly, a pressure applied to the water tank 100 by the washing water may be uniformly formed, thereby preventing the bulging of the water tank 100.

As shown in FIG. 5, the water tank 100 may be laid down when the after-sales service is performed. Particularly, the water tank 100 may be rotated such that a position of the outside air inlet 250 provided at the lower left is located at the lower right. That is, the water tank 100 may be rotated counterclockwise, and at this time, a washing water flow hole 212 to be described later may be located above the outside air inlet 250.

Referring to FIGS. 4 and 5, the water tank 100 may include a plurality of flow paths 62. Particularly, the water tank 100 may include a first flow path 231, a second flow path 232, a third flow path 233, and a fourth flow path 237.

Hereinafter an original state in which the water tank 100 is erected is referred to as a first state, and a state in which the water tank 100 is rotated and laid down as shown in FIG. 5 for the after-sales service is referred to as a second state.

The water tank 100 may include the first flow path 231 provided to allow washing water to be supplied from the outside and to flow in the first state. The first flow path 231 is provided to allow washing water to be introduced from the water supplier 131 and to be discharged to the water softener connector 133. A flow path wall 236 may be provided to form the first flow path 231.

The flow meter 110 may be installed in the first flow path 231 so as to detect the amount of washing water introduced from the water supplier 131.

At least a portion of the first flow path 231 of the water tank 100 may be bent inside the water tank 100 to have a predetermined curvature. The first flow path 231 includes at least one bent member in order to secure a flow stability of the introduced water.

An air break hole 160 may be formed on the first flow path 231 of the water tank 100. Particularly, the air break hole 160 may be formed in the flow path wall 236 forming the first flow path 231. Details related thereto will be described later.

Washing water discharged to the water softener connector 133 is introduced into the reservoir 210 through the soft water inlet 134 after passing through a softening process in the water softer. The water softener (not shown) may include a water softening tank (not shown) equipped with an ionization resin filter, and a regeneration tank (not shown) containing substances such as salt to purify the ionization resin filter mounted on the water softening tank. Washing water that is softened by the water softer and introduced into the water tank 100 may be stored in the reservoir 210.

The water tank 100 may include the plurality of ribs 150 provided to guide the movement of the washing water so as to allow the washing water to be smoothly moved through the soft water inlet 134 and the sump connector 135 in the first state of the water tank 100. The plurality of ribs 150 may be formed in the reservoir 210. Each of the ribs may include a first rib 151 disposed diagonally and a second rib 152 disposed in a direction substantially perpendicular to the first rib 151. A plurality of first ribs 151 and second ribs 152 may be disposed to be spaced apart from each other. The plurality of ribs 150 may be provided to guide the water to be smoothly moved in the reservoir 210 inside the water tank 100.

In the first state, the reservoir 210 may be filled with the introduced washing water until the washing water comes into contact with an inclined rib 220. At this time, the inclined rib 220 may be formed to allow an air pocket (P) to be formed under the inclined rib 220. The inclined rib 220 may be provided to have an inclination with respect to a water surface of the washing water. Details related to the inclined rib 220 will be described later.

The water tank 100 may include the second flow path 232. The second flow path 232 may be provided to allow washing water overflowing from the reservoir 210 to be moved. The washing water flow hole 212 may be provided at one side of the inclined rib 220 to allow washing water to be moved from the reservoir 210 to an upper portion of the inclined rib 220. The washing water may be introduced into the tub 12 through the tub connection port 240 from the reservoir 210 along the second flow path 232.

Further, the second flow path 232 may be provided to allow air to be moved. The second flow path 232 may be provided to connect the reservoir 210, the tub connection port 240, and the outside air inlet 250. Accordingly, an internal pressure of the tub 12 and an internal pressure of the water tank 100 may be maintained at atmospheric pressure. Therefore, because a closed space is not filled with the washing water, washing water may be easily supplied into the water tank 100 without resistance.

The water tank 100 may include the third flow path 233. The third flow path 233 is provided to regenerate the water softer (not shown) by using washing water stored in the reservoir 210. The third flow path 233 may be provided to connect the reservoir 210 to the regeneration water inlet 132. The washing water stored in the reservoir 210 is moved to the third flow path 233 through a second water flow wall 235.

The water tank 100 may include the fourth flow path 237. The fourth flow path 237 may be provided as a drain flow path 62. The fourth flow path 237 may be provided to connect the sump drain connector 136 to the drain hose connector 137. The fourth flow path 237 may be provided to allow the washing water, which is after use, to be discharged to the outside by the drain pump (not shown).

In the embodiment, the outside air inlet 250 may be provided to be located at the lower left side of the water tank 100, and the washing water flow hole 212 may be located at the upper right side of the water tank 100 based on the first state. However, the position of the outside air inlet 250 may vary according to the position of the washing water flow hole 212. For example, when the washing water flow hole 212 is provided to be located at the upper left side of the water tank 100, the outside air inlet 250 may be located at the lower right side of the water tank 100.

In the second state of the water tank 100, the washing water stored in the reservoir 210 may flow into the second flow path 232 through the washing water flow hole 212. As the washing water flow hole 212 and the outside air inlet 250 are arranged in a substantially diagonal direction in the water tank 100, a flow path of the washing water overflowing through the washing water flow hole 212 may be increased. Accordingly, a plurality of structures may be formed on the second flow path 232 to prevent the washing water from leaking into the outside air inlet 250.

Referring to FIGS. 4 to 6, the water tank 100 may include the inclined rib 220. The inclined rib 220 may be formed above the reservoir 210.

The water tank 100 may include a partition wall 211. The partition wall 211 may be provided to form the side surface 12*d* of the reservoir 210. The partition wall 211 may be provided to form a portion of the flow path wall 236 forming the first flow path 231. Particularly, the partition wall 211 may be provided to form a left side surface of the reservoir 210.

The inclined rib 220 may include an extension 221 and a free end 222. The inclined rib 220 may be provided to be connected to the partition wall 211. The extension 221 is a portion, connected to the partition wall 211, in the inclined rib 220. The free end 222 may be formed at one end of the extension 221. The washing water flow hole 212 may be formed on a lateral side of the free end 222. The washing water stored in the reservoir 210 may be moved to the upper portion of the inclined rib 220 through the washing water flow hole 212.

The washing water introduced into the reservoir 210 may rise until the washing water comes into contact with an inclined rib 220. A water level, when the water surface of the washing water is in contact with the inclined rib 220, is referred to as a full water level of reservoir F.

The inclined rib 220 may be provided to have an inclination with respect to the water surface of the washing water. Particularly, the inclined rib 220 may have an inclination to allow the extension 221 to be positioned higher than the free end 222. In this case, when the washing water rises and reaches the full water level of reservoir F, the extension 221 and the partition wall 211 of the inclined rib 220, and the water surface of the washing water may form a closed space. The air pocket P may be formed in the closed space.

Therefore, by the air pocket P, washing water under the inclined rib 220 may not rise above the full water level of reservoir F.

Washing water, which is additionally supplied after reaching the full water level of reservoir F, may be moved to the upper portion of the inclined rib 220 through the washing water flow hole 212. The washing water flow hole 212 may form the second flow path 232 so as to connect the reservoir 210 and the tub connection port 240.

An inclination angle θ of the inclined rib 220 may be provided to be 10 degrees or less. When the inclined rib 220 has a relatively large inclination angle θ, an area of the air pocket P formed among the partition wall 211, the inclined rib 220 and the water surface may be slightly large and it is difficult to secure a predetermined amount of washing water, stored in the reservoir 210, or more. That is, according to the embodiment, the inclination angle θ of the inclined rib 220 may be provided to be 10 degrees or less in order to secure the predetermined amount of the washing water, or more.

When the water tank 100 is rotated from the first state to the second state, the above-described air pocket P formed under the inclined rib 220 may prevent washing water stored in the reservoir 210 from passing through the washing water flow hole 212 to a certain extent. In other words, even when the water tank 100 is tilted at the full water level, the outflow of the washing water from the reservoir 210 may be interfered with the pressure of the air pocket P, thereby minimizing the overflow of the washing water. Accordingly, it is possible to reduce a risk of leaking the washing water to the outside air inlet 250 along the second flow path.

Referring to FIGS. 4, 5, and 7, the air break hole 160 of the water tank 100 may be formed on the first flow path 231. The air break hole 160 may be formed in the flow path wall 236 forming the first flow path 231. Particularly, the air break hole 160 may be formed in a bent member positioned at an upper portion of the bent member of the flow path wall 236.

The water tank 100 may include a flow rate increasing member 170. The flow rate increasing member 170 is installed in the first flow path 231 to increase the flow rate. The flow rate increasing member 170 may be coupled to the flow path wall 236 so as to reduce a cross-sectional area of the first flow path 231, thereby increasing the flow rate.

The water tank 100 may include a plurality of guide 161 and 162. The plurality of guides 161 and 162 may be provided to guide the washing water flowing out through the air brake hole 160.

The plurality of guides 161 and 162 may include a first guide 161 and a second guide 162. The first guide 161 is formed on the flow path wall 236 forming the first flow path 231 and has a first inclination. The first inclination may be provided at an angle substantially perpendicular to the ground. The second guide 162 may be formed to be spaced apart from the first guide 161, and have a second inclination to guide water to the second flow path 232. The second guide 162 may be disposed below the first guide 161. The second guide 162 may be located under the air brake hole 160.

In addition, the water tank 100 may include a first water flow wall 234 forming the second flow path 232 to guide water, which overflows from the reservoir 210, to the tub 12. In accordance with a position of the first water flow wall 234, a portion of the flow path wall 236 forming the first flow path 231 may be cut to form the second flow path 232. The flow path wall 236 may include a flow groove 236*a* that is cut by a height of the first water flow wall 234.

The first water flow wall 234 may be formed by recessing at least a portion of the first case 200 to a rear side. The rear side is a direction toward the tub 12 from the first case 200.

Washing water may flow on the second flow path 232 through the first water flow wall 234 and the flow groove 236*a*. Particularly, washing water overflowing from the reservoir 210 may flow to the upper portion of the inclined rib through the washing water flow hole 212 as described above, and may be moved to the lateral side of the water tank 100 through the first water flow wall 234 and the flow groove 236*a*. The washing water flowing to the lateral side may be discharged from the water tank 100 to the tub connection port 240 by gravity.

Hereinafter a structure for preventing the leakage of the washing water when the water tank 100 is rotated to the second state for the after-sales service of the dishwasher 1 will be described.

Referring to FIGS. 5 and 8, the water tank 100 may be rotated for the after-sales service. As shown in FIG. 5, the state in which the washing water flow hole 212 is located at the upper portion and the outside air inlet 250 is located at the lower portion may be referred to as the second state. For the after-sales service of the dishwasher 1, the water tank 100 may be rotated in various directions. However, when the water tank 100 is rotated in a direction, in which the door 11 of the dishwasher 1 is located on the floor, opposite to that shown in FIG. 5, the outside air inlet 250 is located at the upper portion of the water tank 100 and thus the leakage of the washing water may not occur. Therefore, the second state in which the water tank 100 is laid down such that the outside air inlet 250 is located at the lower right side of the water tank 100 as shown in FIG. 5, for the after-sales service will be described.

When the water tank 100 is rotated to the second state, the leakage of the washing water stored in the reservoir 210, to the outside air inlet 250 may be primarily prevented by the inclined rib 220.

Particularly, because the inclined rib 220 is provided to form the side surface 12*d* of the reservoir 210, the inclined rib 220 may serve to confine a portion of the washing water stored in the reservoir 210 during rotation of the water tank.

In addition, when the water tank 100 is rotated, the air pocket P shown in FIG. 6 may be moved along the water surface of the washing water, thereby preventing the washing water from leaking into the washing water flow hole 212 to a certain extent. By the pressure of the air pocket P, it is possible to prevent the primary outflow of the washing water flowing through the second flow path 232.

However, due to the washing water flow hole 212, it is impossible to completely prevent the washing water from leaking into the second flow path 232. Accordingly, various structures may be formed to prevent the washing water, which flows along the second flow path 232, from leaking into the outside air inlet 250.

The water tank 100 may include a water overflow prevention rib 260. The water overflow prevention rib 260 may be formed at the end 281*b* of the second flow path 232. The water overflow prevention rib 260 may guide the washing water to the tub connection port 240 in the first state of the water tank 100. However, in the second state of the water tank 100, the water overflow prevention rib 260 may interfere with the flow of the washing water along the second flow path 232 so as to prevent the washing water from overflowing to a side adjacent to the outside air inlet 250. The water overflow prevention rib 260 may extend along a periphery of the tub connection port 240. Particularly, the water overflow prevention rib 260 may extend in a direction, which is opposite to gravity based on the second state of the water tank 100, to interfere with the flow of washing water.

The water tank 100 may include a water collecting rib 270. The water collecting rib 270 may be formed between the tub connection port 240 and the outside air inlet 250. The water collecting rib 270 may be provided to collect the washing water overflowing from the water overflow prevention rib 260 in the second state of the water tank 100.

The water collecting rib 270 may include a first wall 271, a second wall 272, and a third wall 273. The first wall 271 may extend from the tub connection port 240 to the lateral side of the water tank 100. The second wall 272 may be connected to the first wall 271 and extend upward based on the first state of the water tank 100. The third wall 273 may be connected to the second wall 272 to extend upwards of the tub connection port 240 based on the first state of the water tank 100. Accordingly, a water collecting space may be formed between the first wall 271, the second wall 272, and the third wall 273, so as to collect the washing water.

The water tank 100 may include a plurality of leakage prevention ribs 281, 282, and 283. The plurality of leakage prevention ribs 281, 282, and 283 may be provided between the water collecting rib 270 and the outside air inlet 250. The plurality of leakage prevention ribs 281, 282, and 283 may prevent water, which is not collected by the water collecting rib 270 and overflows from the water collecting rib 270, from leaking to the outside air inlet 250 when the water tank 100 is rotated.

Each of the leak prevention ribs 281, 282, 283 may include a connector 281*a* and an end 281*b*. The connector 281*a* may be connected to an inner wall 201 of the water tank 100 or spaced apart from the inner wall 201 of the water tank 100. The end 281*b* may be formed at one end of the connector 281*a* to allow air to pass therethrough.

The adjacent leakage prevention ribs 281, 282, and 283 may allow the flow path 62, through which the air flows, to be a zigzag pattern and thus it is difficult for the washing water to pass through the flow path 62 while the air easily passes through the flow path 62. Particularly, each of the leak prevention ribs 281, 282, and 283 may be inclined to allow the end 281*b* to be higher than the connector 281*b* based on the first state of the water tank 100.

Referring to FIGS. 4 and 9, the water tank 100 may include the second water flow wall 235. The second water flow wall 235 may be formed by being recessed to the rear of the water tank 100. The second water flow wall 235 may be provided to allow the washing water stored in the reservoir 210 to flow into the third flow path 233.

The water softener (not shown) is configured to adsorb and remove heavy metals and metallic ions contained in the washing water flowing into the water supplier 131. The water softener (not shown) changes washing water into soft water with excellent cleaning power. However, as an ion exchange resin adsorbs the metallic ions contained in the washing water, a volume of the ion exchange resin inside the water softener (not shown) is increased, and thus a capacity of the ion exchange resin for adsorbing the metallic ions may be reduced.

Therefore, by supplying water to the regeneration water inlet 132 for the ion exchange, it is possible to regenerate the ion exchange resin of the water softener (not shown) to restore the water softening ability. Regeneration of the ion exchange resin is a process of removing metallic ions contained in the ion exchange resin. Accordingly, the ions in the ion exchange resin, which are depleted as the softening reaction continues, may be reduced by the ion exchange reaction.

Therefore, through the second water flow wall 235, it is possible to store and supply the washing water required for regeneration of the water softener (not shown).

As in the above-described embodiment of the present disclosure, the inner surfaces of the first case 200 and the second case 300 are not limited to being provided to partition the above-described respective structures. For example, the above-described structure may be provided only on the inner surface of the first case 200, and the inner surface of the second case 300 may be provided with a flat surface to cover the first case 200, thereby providing a closed space inside the water tank 100. Alternatively, the above-described structure may be provided only on the inner surface of the second case 300, and the inner surface of the first case 200 may be provided with a flat surface to cover the second case 300, thereby providing a closed space inside the water tank 100.

Even when the water tank 100 is rotated as the dishwasher 1 is rotated upon performing the after-sales service, the washing water stored in the water tank 100 may not leak to the outside by the above-mentioned structure. Accordingly, it is possible not to affect products around the dishwasher 1, and thus the service satisfaction of the consumer may be increased.

Figure 10:
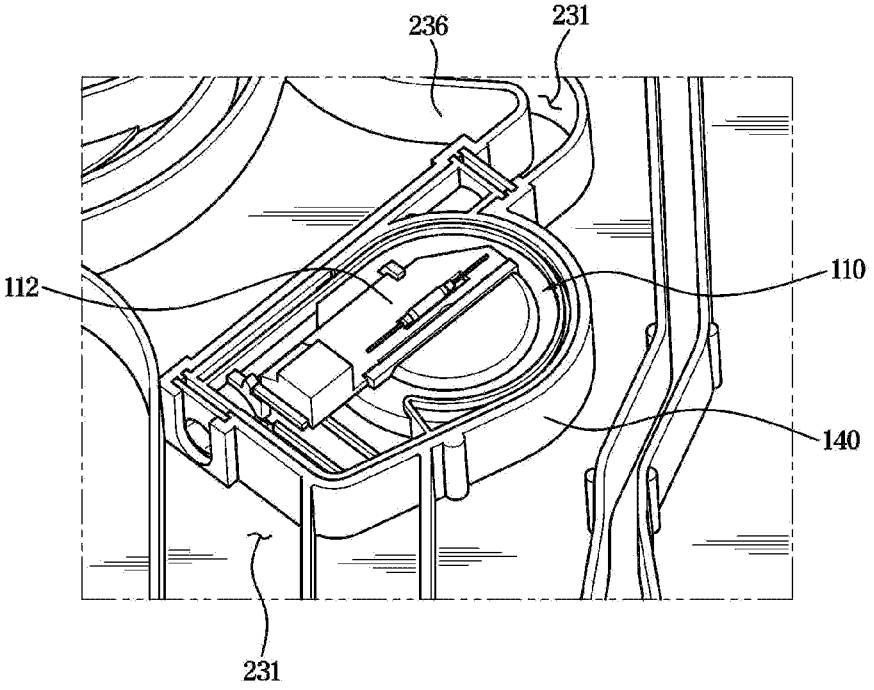
FIG. 10 is an enlarged view illustrating a state in which a flow meter is mounted on a part D of FIG. 4.
Figure 11:
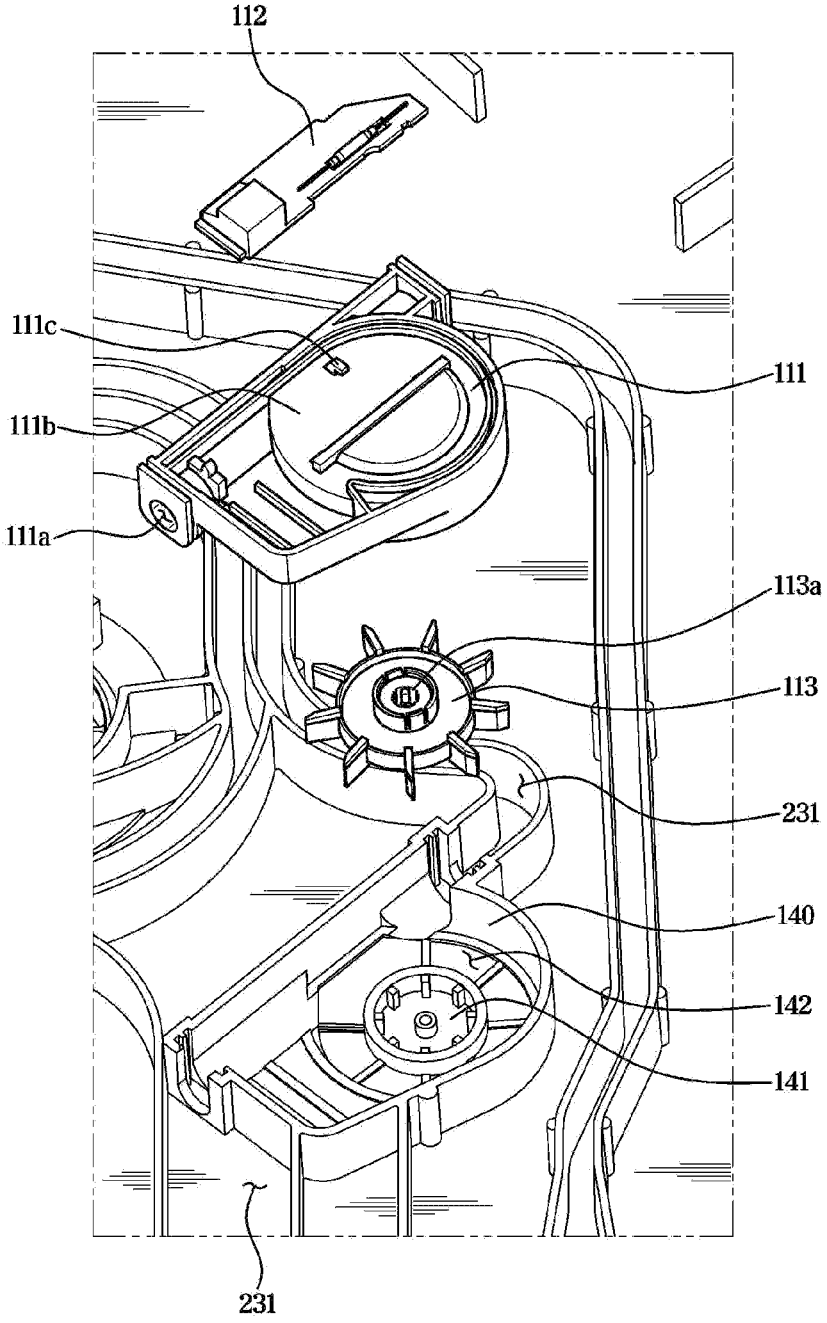
FIG. 11 is an exploded view of the flow meter of FIG. 10.

FIG. 10 is an enlarged view illustrating a state in which a flow meter is mounted on a part D of FIG. 4. FIG. 11 is an exploded view of the flow meter of FIG. 10.

Referring to FIGS. 10 and 11, the water tank 100 may include the flow meter 110. The flow meter 110 may be mounted on a flow meter installation member 140 of the first case 200. The flow meter installation member 140 may include an accommodation space 142 to accommodate the flow meter 110. The flow meter 110 is installed on the first flow path 231 to detect the flow rate of the washing water supplied from the water supplier 131.

The flow meter 110 may include an impeller 113, a body 111, and a printed circuit board (PCB) 112.

The body 111 may include a flow path hole 111*a* forming the flow path 231 and provided to allow washing water to be supplied from the water supplier and to flow. The body 111 may include a PCB mounting member 111*b* on which the PCB 112 is mounted. In addition, the body 111 may include a PCB fixing protrusion 111*c* provided to fix a position of the PCB 112. Accordingly, the PCB 112 may be detachably mounted on the body 111.

The PCB mounting member 111*b* may be formed on an upper surface of the body 111. The PCB 112 may be mounted on the upper surface of the body 111 such that a portion of the PCB 112 is exposed to the outside of the water tank 100. The PCB 112 may be connected to a wire for receiving power from the outside and sending and receiving signals.

The impeller 113 may be accommodated in the body 111. The impeller 113 may be mounted on an impeller mounting member 141 of the first case 200. The impeller 113 may include a magnet seating member 113*a*. The impeller 113 may be rotated by the supplied washing water. Through a magnet (not shown) mounted on the impeller 113, a signal regarding a rotation speed of the impeller 113 may be transmitted to the PCB 112 so as to detect the flow rate.

Figure 12:
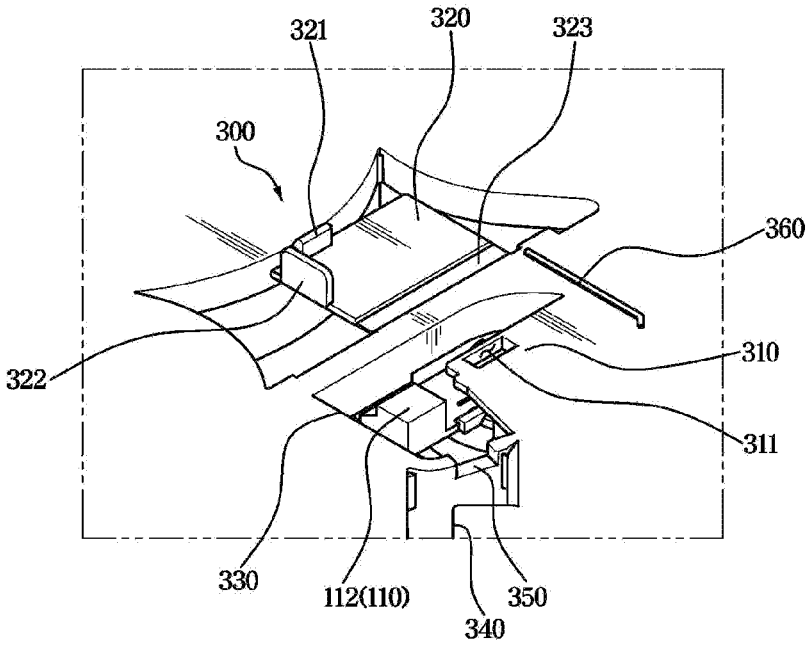
FIG. 12 is a view illustrating a state in which a folding flange is not folded in the water tank of the dishwasher according to one embodiment of the present disclosure.
Figure 13:
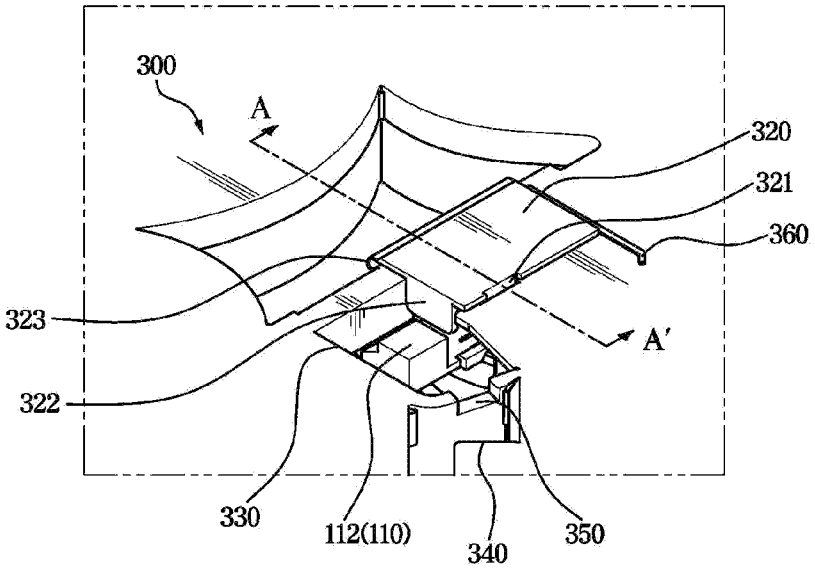
FIG. 13 is a view illustrating a state in which the folding flange of FIG. 12 is folded.

FIG. 12 is a view illustrating a state in which a folding flange is not folded in the water tank of the dishwasher according to one embodiment of the present disclosure. FIG. 13 is a view illustrating a state in which the folding flange of FIG. 12 is folded.

Referring to FIGS. 10 to 13, the second case 300 may cover the flow meter 110 mounted on the first case 200. The second case 300 may be provided to fix the position of the flow meter 110 accommodated in the first case 200. Particularly, the second case 300 may include a cover 310 provided to cover a portion of the flow meter 110.

The second case 300 may include a folding flange 320. The folding flange 320 is provided to be foldable. The folding flange 320 may be integrally formed with the second case 300.

The folding flange 320 may include a hook 321. The hook 321 may be formed at one end of the folding flange 320. The hook 321 may be coupled to the cover 310 to allow the folding flange 320 to cover the flowmeter 110.

The folding flange 320 may include a protector 322 extending in the same direction as the hook 321. When the folding flange 320 is folded, the extension 221 may cover a portion of a space between the PCB 112 and the second case 300 so as to protect the PCB 112.

The folding flange 320 may include a folding member 323. The folding member 323 may be formed to be deformable to allow the folding flange 320 to be folded.

The cover 310 may include a hook insertion hole 311. When the folding flange 320 is in a folded state, the hook 321 may be inserted into the hook insertion hole 311.

The second case 300 may include an opening 330 provided adjacent to the cover 310. The opening 330 may be formed by cutting a portion of the second case 300. Through the opening 330, the PCB 112 of the flow meter 110 may be exposed to the outside. Accordingly, the PCB 112 exposed through the opening 330 may be connected to a wire.

As illustrated in FIGS. 3, 12 and 13, the second case 300 may include a wire hanger 340 connected to the opening 330. The wire hanger 340 may be formed by cutting a portion of the second case 300. The wire hanger 340 may be cut from the opening 330 toward the lower portion of the water tank 100.

A wire groove 350 may be formed between the opening 330 and the wire hanger 340. The wire groove 350 may be formed by cutting a portion of the second case 300 to the rear side. A position of the wire connected to the PCB 112 may be temporarily fixed through the wire groove 350. Accordingly, the wire hanger 340 may be formed to guide the wire connected to the PCB 112.

The second case 300 may include a guard 360. The guard 360 may protrude from an outer surface of the second case 300 to prevent moisture from penetrating into the PCB 112.

Figure 14:
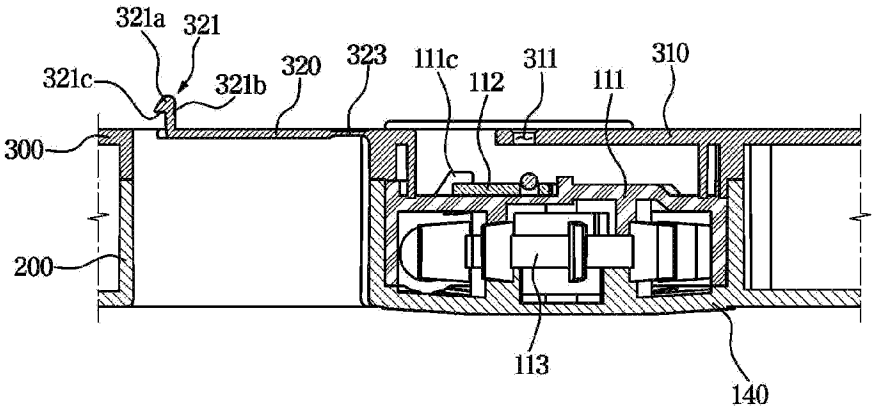
FIG. 14 is a cross-sectional view taken along line A-A' of FIG. 13, illustrating a state in which the folding flange is not folded.
Figure 15:
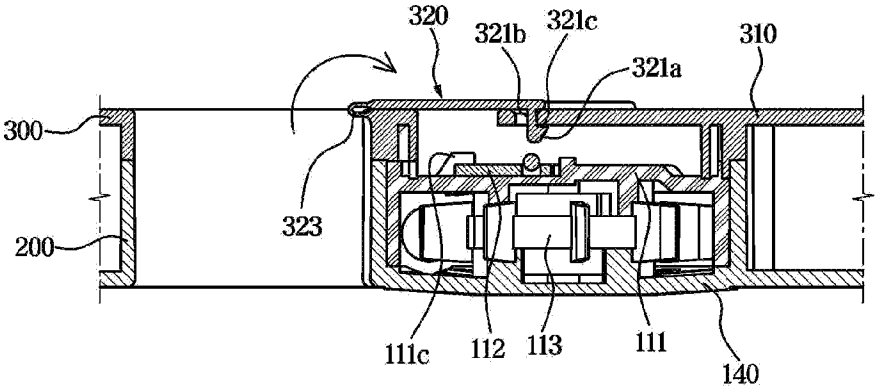
FIG. 15 is a view illustrating a state in which the folding flange of FIG. 14 is folded.

FIG. 14 is a cross-sectional view taken along line A-A' of FIG. 13, illustrating a state in which the folding flange is not folded. FIG. 15 is a view illustrating a state in which the folding flange of FIG. 14 is folded.

Referring to FIGS. 14 and 15, the hook 321 of the folding flange 320 may include a connector 321*b* and a locker 321*a*. The connector 321*b* may extend to the outside of the folding flange 320 by approximately a thickness of the second case 300. The locker 321*a* may be formed at one end of the connector 321*b*. In the folded state of the folding flange 320, the locker 321*a* passes through the hook insertion hole 311 of the cover 310 and is caught by the cover 310.

The hook 321 may further include a flat member 321*c*. The flat member 321*c* may be provided on the locker 321*a*. The water tank 100 according to the present disclosure is generally formed by injection molding. Because the hook 321 includes the flat member 321*c*, a mold for injection molding the hook 321 may be provided in a vertical separation structure. In other words, a separate slide core is not required and the mold is formed by separating only upper and lower parts of the mold. Accordingly, it is possible to reduce a mold manufacturing cost.

The PCB 112 of the flow meter 110 is typically fused together inside the water tank 100. Accordingly, when a defect or malfunction occurs, it is impossible to only replace the PCB 112, but it is required to replace the entire water tank 100.

However, according to the present disclosure, because the folding flange 320 is formed in the water tank 100, a user or an engineer can selectively release the coupling between the folding flange 320 and the cover 310.

Accordingly, when a user removes the hook 321 of the folding flange 320 from the cover 310 by using a simple tool on the outside of the dishwasher 1, the user can access the PCB 112. Accordingly, it is possible to easily replace only the PCB 112 and thus it is possible to reduce a repair cost and a service cost.

While the present disclosure has been particularly described with reference to exemplary embodiments, it should be understood by those of skilled in the art that various changes in form and details may be made without departing from the spirit and scope of the present disclosure.

What is claimed is:

1. A dishwasher, comprising:

a tub forming a washing chamber;

a water tank mounted on an outer circumferential surface of the tub and including:

a reservoir in which washing water is storable, and an inclined rib including a free end, wherein, with the dishwasher in an erect position, the inclined rib is inclined downward toward the free end to allow washing water stored in the reservoir to flow to an upper portion of the inclined rib, and the inclined rib is configured to, with the dishwasher in the erect position and washing water stored in the reservoir at a full water level, have an inclination with respect to a water surface of the washing water so that an air pocket is formed under the inclined rib and so that, when the dishwasher is rotated from the erect position with the washing water stored in the reservoir at the full water level and the air pocket formed under the inclined rib, at least a portion of the washing water stored in the reservoir is trapped by the air pocket; and a sump configured to receive washing water stored in the reservoir and to supply the received washing water to the tub.

2. The dishwasher of claim 1, wherein the water tank further includes a partition wall forming a side of the reservoir, and the inclined rib includes:

an extension connected to the partition wall, and the free end is at one end of the extension.

3. The dishwasher of claim 2, wherein the inclined rib is inclined so that the extension is higher than the free end when the dishwasher is in the erect position.

4. The dishwasher of claim 3, wherein the partition wall, the extension, and the water surface of the washing water form a closed space in which the air pocket is formed when the dishwasher is in the erect position.

5. The dishwasher of claim 2, wherein the water tank further includes a first flow path along which washing water is suppliable to the water tank from an outside, and the partition wall forms a portion of a flow path wall forming the first flow path.

6. The dishwasher of claim 5, wherein the water tank further includes:

a tub connection port formed to communicate with the tub, an outside air inlet, and a second flow path connecting the reservoir, the tub connection port, and the outside air inlet to allow air to flow.

7. The dishwasher of claim 6, wherein the water tank further includes a water overflow prevention rib extending along a periphery of the tub connection port so as to interfere with a flow of washing water, which overflows from the reservoir, along the second flow path due to the rotation of the dishwasher.

8. The dishwasher of claim 6, wherein the water tank further includes a water collecting rib formed between the tub connection port and the outside air inlet so as to collect the washing water in response to the rotation of the dishwasher.

9. The dishwasher of claim 8, wherein the water collecting rib includes:

a first wall extending from the tub connection port to a lateral side of the water tank, a second wall connected to the first wall and extending upward, and a third wall connected to the second wall and extending to an upper side of the tub connection port.

10. The dishwasher of claim 8, wherein the water tank further includes a plurality of leakage prevention ribs formed between the water collecting rib and the outside air inlet so as to prevent water, which is not collected by the water collecting rib, from leaking to the outside air inlet in response to the rotation of the dishwasher.

11. The dishwasher of claim 1, wherein the water tank further includes:

a flow meter configured to detect a flow rate of washing water supplied to the water tank, a first case in which the flow meter is accommodated, and a second case corresponding to the first case and including a cover provided to cover a portion of the flow meter.

12. The dishwasher of claim 11, wherein the second case includes a folding flange provided to be foldable and including a hook formed on one end of the folding flange, and the hook is coupled to the cover to allow the folding flange to cover the flow meter.

13. The dishwasher of claim 11, wherein the flow meter includes:

a body comprising an impeller, and a printed circuit board (PCB) detachably mounted to the body so as to be connected to a wire, and the second case includes a wire hanger formed to be cut so as to guide the wire.

14. The dishwasher of claim 13, wherein the second case further includes a guard protruding from an outer surface of the second case to prevent moisture from penetrating into the PCB.

* * * * *